US008970441B2

(12) United States Patent
Yun et al.

(10) Patent No.: US 8,970,441 B2
(45) Date of Patent: Mar. 3, 2015

(54) ANTENNA APPARATUS

(71) Applicant: Electronics and Telecommunications Research Institute, Daejeon (KR)

(72) Inventors: So Hyeun Yun, Daejeon (KR); Hong Yeol Lee, Cheongju-si (KR); Chang Soo Kwak, Daejeon (KR); Man Seok Uhm, Daejeon (KR); Jang Sup Choi, Daejeon (KR); In Bok Yom, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 211 days.

(21) Appl. No.: 13/656,437

(22) Filed: Oct. 19, 2012

(65) Prior Publication Data

US 2013/0127680 A1 May 23, 2013

(30) Foreign Application Priority Data

Oct. 21, 2011 (KR) ..... 10-2011-0107901

(51) Int. Cl.

| | |
|---|---|
| ***H01Q 13/00*** | (2006.01) |
| ***H01Q 13/02*** | (2006.01) |
| ***H01Q 21/08*** | (2006.01) |
| ***H01Q 25/00*** | (2006.01) |

(52) U.S. Cl.

CPC ..... *H01Q 21/08* (2013.01); *H01Q 13/0275* (2013.01); *H01Q 25/00* (2013.01)

USPC ..... 343/776; 343/786

(58) Field of Classification Search

CPC ..... H01Q 13/0275

USPC ..... 343/776, 786

See application file for complete search history.

(56) References Cited

U.S. PATENT DOCUMENTS

| | | | | |
|---|---|---|---|---|
| 4,878,061 | A * | 10/1989 | Nusair et al. | 343/786 |
| 6,995,728 | B2 * | 2/2006 | Rodriguez | 343/786 |
| 7,664,533 | B2 | 2/2010 | Logothetis et al. | |
| 7,969,376 | B2 * | 6/2011 | Steghafner et al. | 343/786 |
| 2010/0238086 | A1 * | 9/2010 | Moon et al. | 343/786 |

FOREIGN PATENT DOCUMENTS

| | | | |
|---|---|---|---|
| KR | 1020050103608 | A | 11/2005 |
| KR | 1020060047294 | A | 5/2006 |
| KR | 101021674 | B1 | 3/2011 |

* cited by examiner

*Primary Examiner* — Robert Karacsony

(74) *Attorney, Agent, or Firm* — William Park & Associates Patent Ltd.

(57) ABSTRACT

Provided is an antenna apparatus which employs a small number of antenna devices and is intended to obtain a desired pattern without adjusting amplitude level and phase of each antenna device. The antenna apparatus includes a first ridge horn antenna, and a second ridge horn antenna spaced apart from the first ridge horn antenna by a determined distance. Here, a multi-beam pattern is generated using a third-order mode beam pattern of a synthetic beam obtained by synthesizing beams respectively radiated from the first and second ridge horn antennas. Accordingly, the antenna apparatus can be simplified, and a desired multi-beam pattern can be obtained without adjusting signal level and phase of each antenna device. Also, by employing the ridge horn antennas as array devices, the antenna apparatus can be used in a wide frequency band.

5 Claims, 8 Drawing Sheets

I - I'

ANTENNA APPARATUS

CLAIM FOR PRIORITY

This application claims priority to Korean Patent Application No. 10-2011-0107901 filed on Oct. 21, 2011 in the Korean Intellectual Property Office (KIPO), the entire contents of which are hereby incorporated by reference.

BACKGROUND

1. Technical Field

Example embodiments of the present invention relate in general to an antenna, and more particularly, to an antenna apparatus capable of generating a multi-beam pattern.

2. Related Art

These days, to provide mobile communication service, there is an increasing demand for an antenna that has a wideband or multi-band frequency characteristic in terms of frequency, and can project a beam in a specific direction or implement multiple beams.

An array antenna can project a main beam in a desired direction without physical movement, and generate a multi-beam pattern with one phase array. Due to such characteristics, the array antenna is mainly used to project a beam in a specific direction or generate a multi-beam pattern.

A beam pattern of the array antenna is determined according to shape, direction, and spatial position of individual antenna devices, and level and phase of a feeding current. Here, the level and phase of the feeding current are adjusted in a beamforming network. Also, when the number of array devices constituting the array antenna is N (here, N is a natural number equal to or greater than 1), the number of variables for adjusting a beam projection direction is N×2.

Thus, to generate a multi-beam pattern using a conventional array antenna, the level and phase of the feeding current need to be controlled. Also, the greater the number of array devices, the greater the number of variables to be controlled, and the more complex the array antenna becomes.

SUMMARY

Accordingly, example embodiments of the present invention are provided to substantially obviate one or more problems due to limitations and disadvantages of the related art.

Example embodiments of the present invention provide an antenna apparatus having a simple constitution and capable of generating a multi-beam pattern.

In some example embodiments, an antenna apparatus includes: a first ridge horn antenna; and a second ridge horn antenna spaced apart from the first ridge horn antenna by a determined distance. Here, a multi-beam pattern is generated using a third-order mode beam pattern of a synthetic beam obtained by synthesizing beams respectively radiated from the first and second ridge horn antennas.

Here, the determined distance may be obtained by changing at least one of a phase constant, an inclination angle of a traveling wave with respect to an array axis, and a phase difference between the antenna devices.

Here, when the first ridge horn antenna and the second ridge horn antenna are spaced apart by a distance corresponding to an odd number of times a half wavelength (0.5λ) of an operating frequency, the antenna apparatus may generate as many main beam patterns as the odd number of times.

Here, when the first ridge horn antenna and the second ridge horn antenna are spaced apart by a distance corresponding to an even number of times a half wavelength (0.5λ) of an operating frequency, the antenna apparatus may generate as many main beam patterns as a number calculated by subtracting one from the even number of times.

Here, the determined distance may be 6λ or less.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS OF THE PRESENT INVENTION

Figure 1:
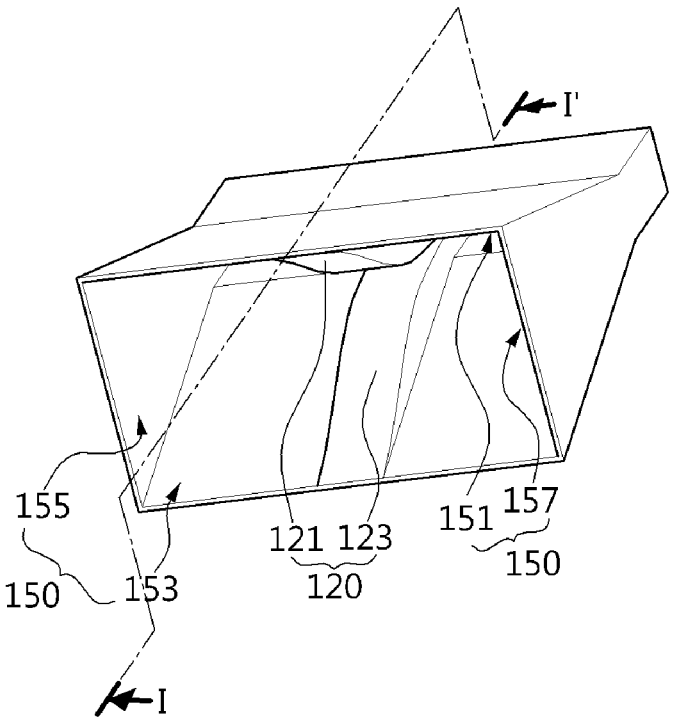
FIG. 1 is a perspective view of a ridge horn antenna.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" with another element, it can be directly connected or coupled with the other element or intervening elements may be present. In contrast, when an element is referred to as being "directly connected" or "directly coupled" with another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments of the present invention will be described in detail with reference to the appended drawings. To aid in understanding the present invention, like numbers refer to like elements throughout the description of the figures, and the description of the same component will not be reiterated.

Figure 2:
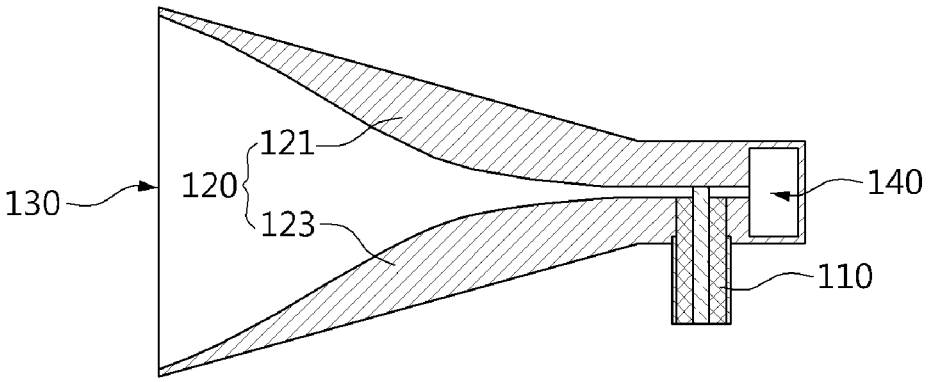
FIG. 2 is a cross-sectional view taken along line I-I' of the ridge horn antenna shown in FIG. 1.

FIG. 1 is a perspective view of a double ridge horn antenna, and FIG. 2 is a cross-sectional view taken along line I-I' of the ridge horn antenna shown in FIG. 1.

Referring to FIGS. 1 and 2, a double ridge horn antenna may include an input adapter 110, ridges 120, an aperture plane 130, a resonator 140, and flares 150.

Upper and lower flares 151 and 153 and left and right flares 155 and 157 of the ridge horn antenna serve to cause an electric field to propagate in the horn, and maintain the shape of the horn antenna.

The input adapter 110 supplies the ridge horn antenna with current. Here, energy input to the input adapter 110 is transferred to upper and lower ridges 121 and 123, such that the upper ridge 121 is positively (+) charged and the lower ridge 123 connected with the ground surface of the input adapter 110 is negatively (−) charged.

The electric field formed between the upper and lower ridges 121 and 123 propagates toward the aperture plane 130 of the horn. Here, the distance between the upper and lower ridges 121 and 123 increases toward the horn aperture plane 130 such that impedance gradually becomes the impedance of the horn aperture plane 130.

Meanwhile, due to a structural characteristic of the ridge horn antenna, a very high electric field is formed between the upper and lower ridges 121 and 123, and a low electric field is formed among the upper and lower ridges 121 and 123 and the left and right flares 155 and 157. Also, unlike a general horn antenna, the ridge horn antenna has the upper and lower ridges 121 and 123 installed in the horn to extend the operating frequency range of the horn antenna.

In the ridge horn antenna, the ridges 120 are inserted to lower a start frequency, at which a fundamental mode (e.g., TE10 mode) is formed, and have a uniform beam pattern over a wide band.

The resonator 140 functions to select a resonant frequency from among electromagnetic waves received by the ridge horn antenna so as to electrically or mechanically resonate. Also, the resonator 140 is used for bandwidth extension.

Figure 3:
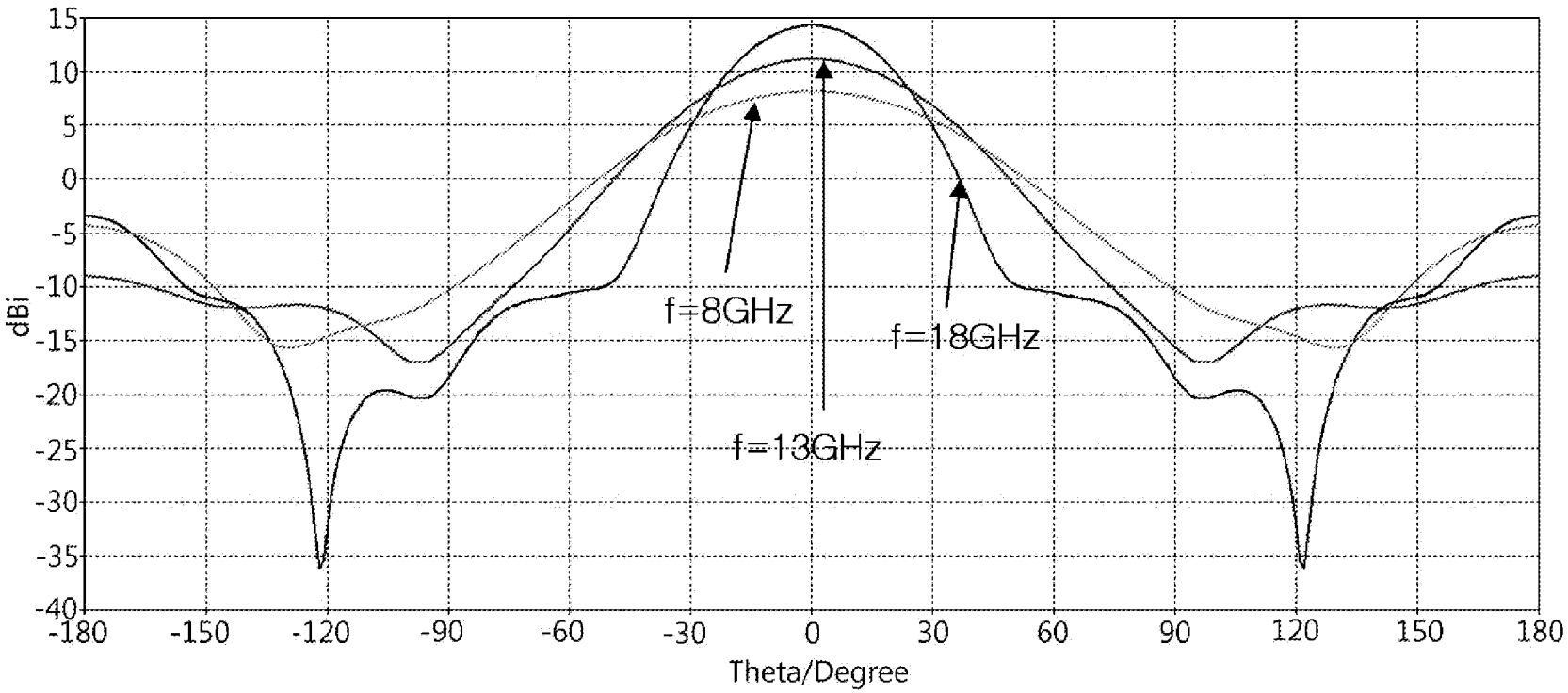
FIG. 3 is a graph showing a beam pattern characteristic of a fundamental mode of a ridge horn antenna.

FIG. 3 is a graph showing a beam pattern characteristic of a fundamental mode of a ridge horn antenna.

In the graph shown in FIG. 3, the x-axis denotes angles in all directions, 360 degrees, around a ridge horn antenna, and the y-axis denotes gains (dBi) of the ridge horn antenna.

Referring to FIG. 3, a beam pattern characteristic of a fundamental mode of the ridge horn antenna varies according to frequency.

With respect to 0 degrees, when the frequency is 8 GHz, the gain (dBi) is about 8 dBi, and when the frequency is 13 GHz, the gain (dBi) is about 11 dBi, which indicates that directivity is increased compared to the case of the frequency being 8 GHz. Also, when the frequency is 18 GHz, the gain (dBi) is about 14.5 dBi, which indicates that directivity is increased compared to the case of the frequency being 13 GHz.

In other words, as a beam pattern characteristic of the fundamental mode of the ridge horn antenna, it is possible to check that the higher the frequency, the higher the directivity.

Figure 4:
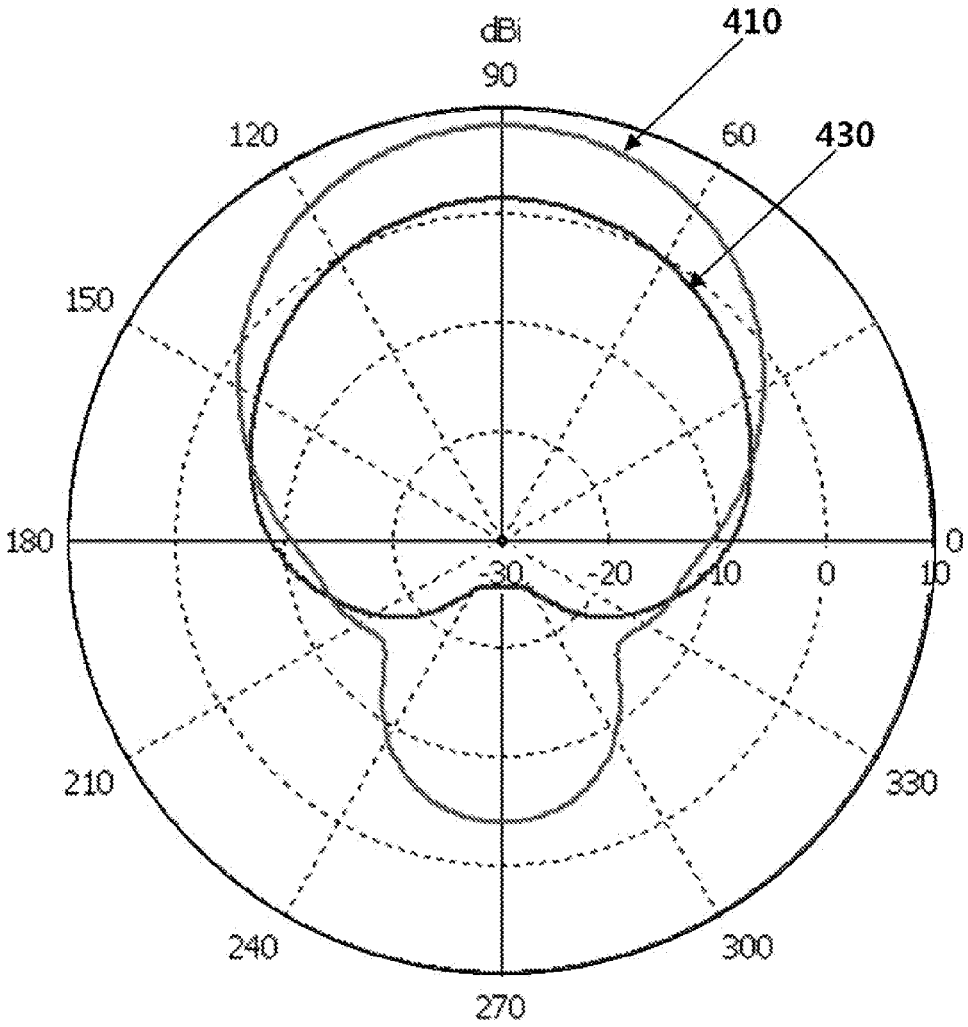
FIG. 4 is a polar diagram showing a first-order mode beam pattern and a third-order mode beam pattern at 8 GHz (f=8 GHz)
Figure 5:
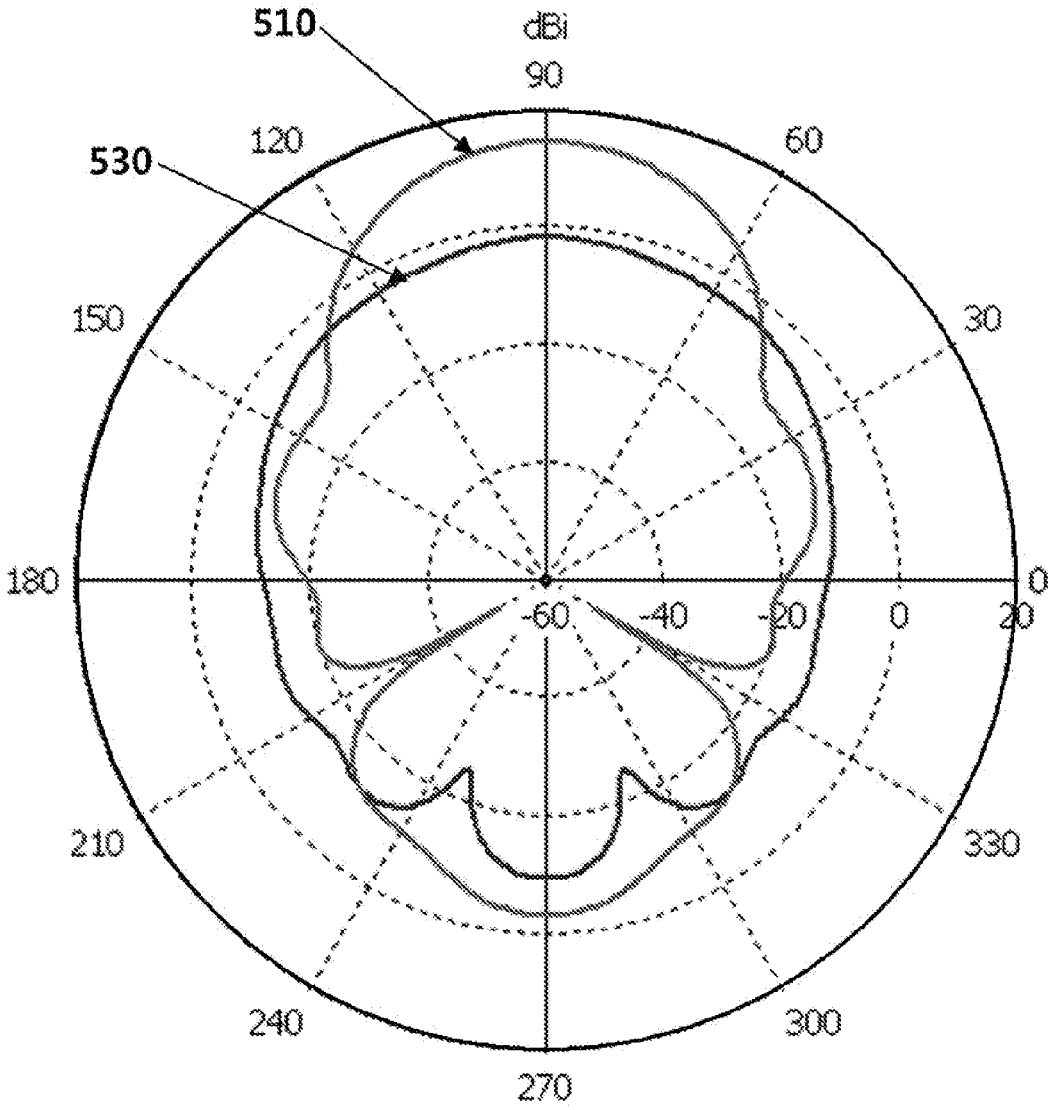
FIG. 5 is a polar diagram showing a first-order mode beam pattern and a third-order mode beam pattern at 18 GHz (f=18 GHz)

FIG. 4 is a polar diagram showing a first-order mode beam pattern and a third-order mode beam pattern at 8 GHz (f=8 GHz), and FIG. 5 is a polar diagram showing a first-order mode beam pattern and a third-order mode beam pattern at 18 GHz (f=18 GHz).

As shown in FIG. 4, a first-order mode beam pattern 410 of a ridge horn antenna has directivity at 8 GHz, but a third-order mode beam pattern 430 of the ridge horn antenna has the omni-directional characteristics at 8 GHz compared to the first-order mode beam pattern 410.

Also, as shown in FIG. 5, a first-order mode beam pattern 510 of the ridge horn antenna has directivity at 18 GHz, but a third-order mode beam pattern 530 of the ridge horn antenna has the omni-directional characteristics at 18 GHz compared to the first-order mode beam pattern 510.

In other words, as shown in FIGS. 4 and 5, it can be seen that the third-order mode beam patterns 430 and 530 of the ridge horn antenna have the quasi-cardioid form at 8 GHz and 18 GHz.

In an antenna apparatus according to an example embodiment of the present invention, a third-order mode beam pattern, which has been rejected for the above-mentioned reason in design of a conventional ridge horn antenna, is used for generating multiple beams.

An antenna apparatus to which a ridge horn antenna according to an example embodiment of the present invention is applied will be described in detail below.

Figure 6:
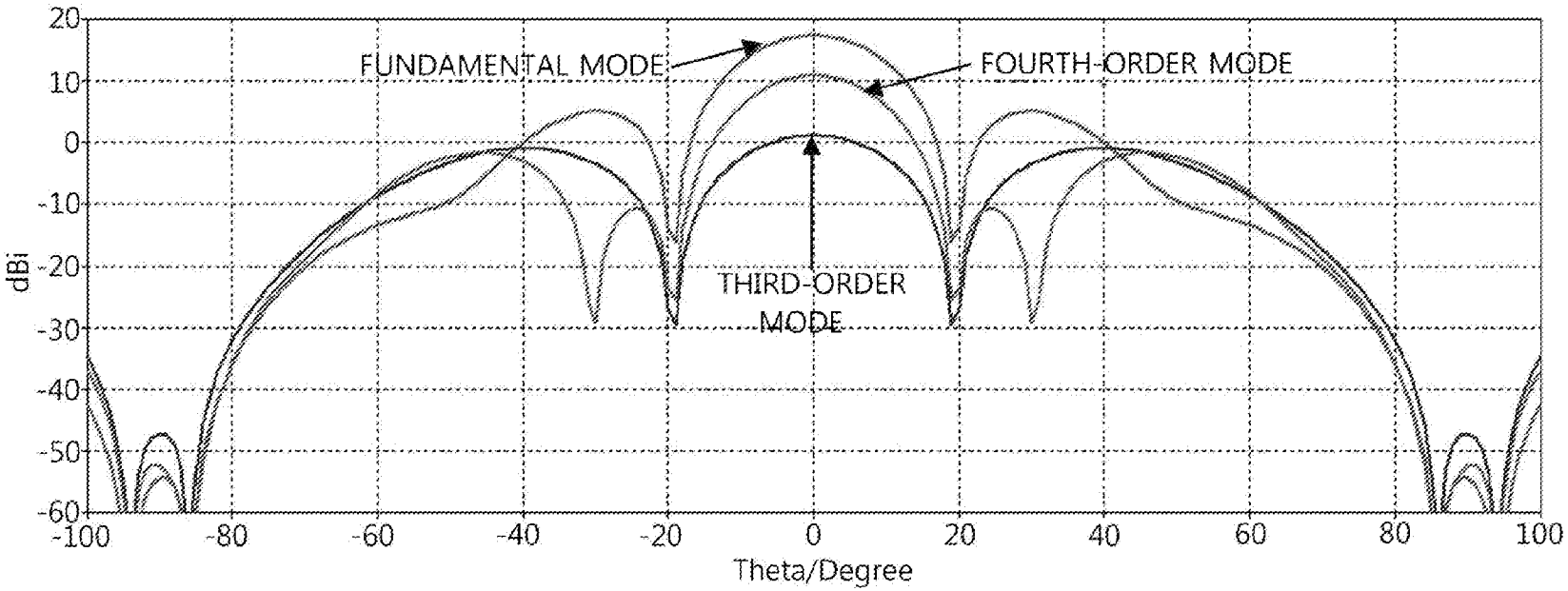
FIG. 6 is a graph showing a beam pattern characteristic according to modes of an antenna apparatus according to an example embodiment of the present invention when the distance between two ridge horn antennas is 1.5λ.

FIG. 6 is a graph showing a beam pattern characteristic according to modes of an antenna apparatus according to an example embodiment of the present invention when the distance between two ridge horn antennas is 1.5λ, In the graph shown in FIG. 6, the x-axis denotes angles in the orthogonal plane of I-I' of FIG. 1 around a ridge horn antenna, and the y-axis denotes gains (dBi) of the ridge horn antenna.

Referring to FIG. 6, since a visible range is one period or more, it can be seen from a fundamental mode beam pattern that side lobes having a gain difference of about 12 dB are generated in addition to a main lobe, and it can also be seen from a fourth-order mode beam pattern that side lobes are generated in addition to a main lobe.

On the other hand, a third-order mode beam pattern has a smaller gain than the fundamental mode beam pattern and the fourth-order mode beam pattern, but the three main lobes (main beam patterns) have the substantially same gain.

Thus, when two ridge horn antennas are employed as array devices and a third-order mode of the ridge horn antennas is used, it is possible to generate a multi-beam pattern using only the two antenna devices and simplify an antenna apparatus, unlike a conventional array antenna that employs a plurality of devices to generate a multi-beam pattern.

Figure 7:
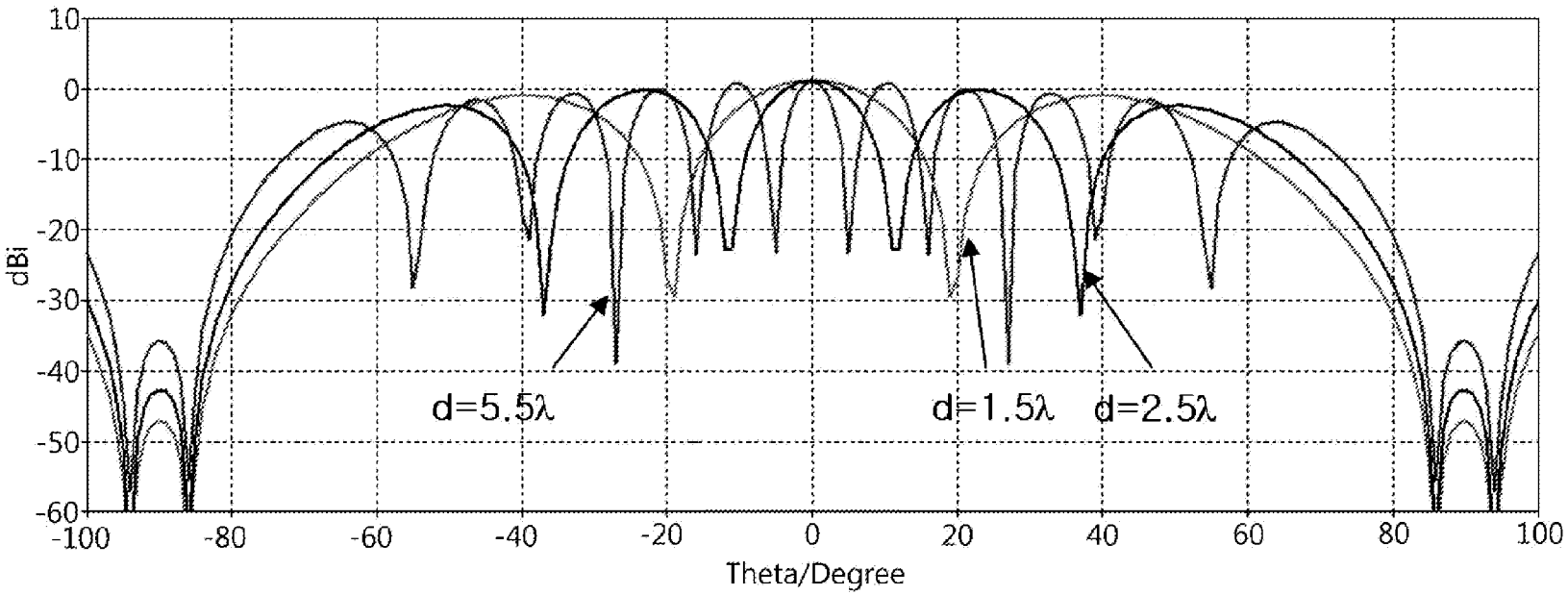
FIG. 7 is a graph showing a beam pattern characteristic when the distance between two ridge horn antennas is an odd number of times a half wavelength.
Figure 8:
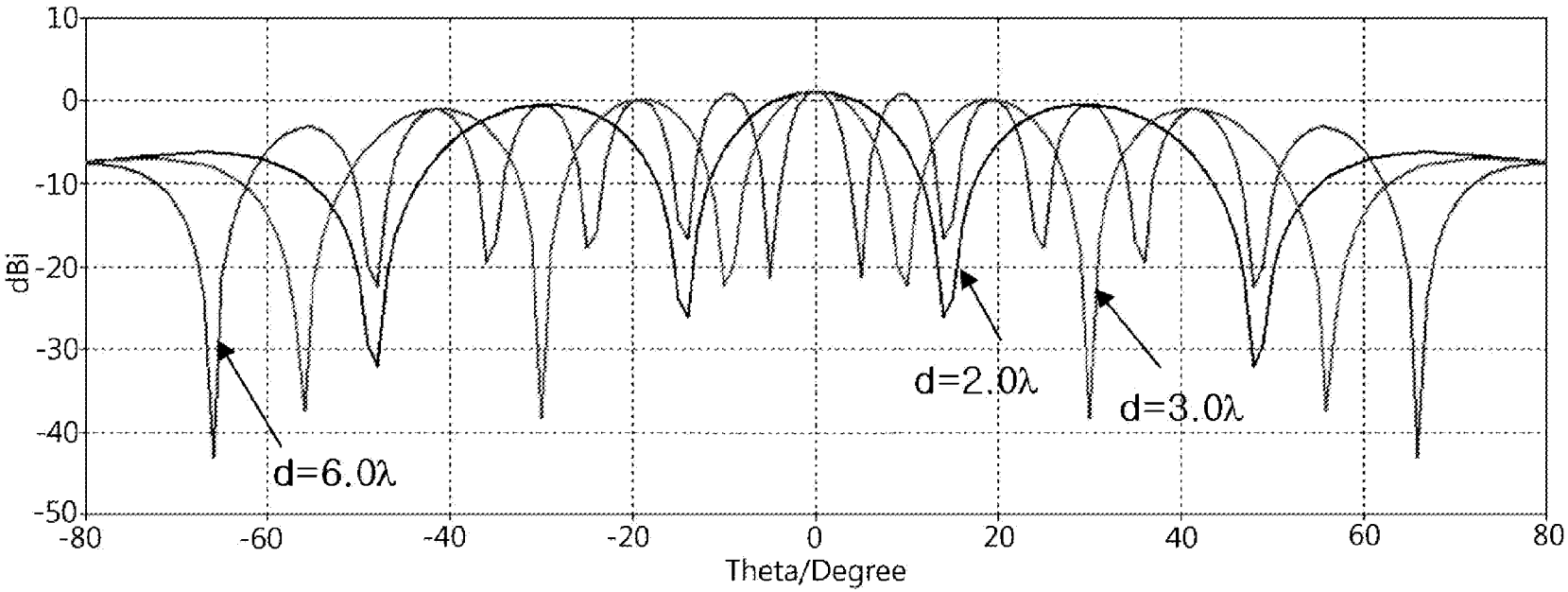
FIG. 8 is a graph showing a beam pattern characteristic when the distance between two ridge horn antennas is an even number of times a half wavelength.

FIG. 7 is a graph showing a beam pattern characteristic when the distance between two ridge horn antennas is an odd number of times a half wavelength, and FIG. 8 is a graph showing a beam pattern characteristic when the distance between the two ridge horn antennas is an odd number of times the half wavelength.

In the graphs shown in FIGS. 7 and 8, the x-axis denotes angles in the orthogonal plane of I-I' of FIG. 1 around a ridge horn antenna, and the y-axis denotes gains (dBi) of the ridge horn antenna.

Referring to FIGS. 7 and 8, when a distance d between two ridge horn antennas having the same signal amplitude and phase is an odd number of times $N_{odd}$ a half wavelength 0.5λ, as many main lobes (main beam patterns) as the odd number of times $N_{odd}$ are generated as shown in FIG. 7.

Specifically, when the distance d between the two ridge horn antennas having the same signal amplitude and phase is three times a half wavelength 0.5λ of an operating frequency of the antenna apparatus, that is, 1.5λ, and a third-order mode beam pattern is used, it can be seen that about three main lobes (main beam patterns) are generated. Also, when the distance d between the two ridge horn antennas is five times the half wavelength 0.5λ of the operating frequency, that is, 2.5λ, and the third-order mode beam pattern is used, it can be seen that about five main lobes (main beam patterns) are generated. Further, when the distance d between the two ridge horn antennas is 11 times the half wavelength 0.5λ of the operating frequency, that is, 5.5λ, and the third-order mode beam pattern is used, it can be seen that about 11 main lobes (main beam patterns) are generated.

Meanwhile, when the distance d between two ridge horn antennas having the same signal amplitude and phase is an even number of times $N_{even}$ a half wavelength, as many main lobes (main beam patterns) as a number calculated by subtracting one from the even number of times $N_{even}$ are generated as shown in FIG. 8.

Specifically, when the distance d between the two ridge horn antennas having the same signal amplitude and phase is four times the half wavelength 0.5λ of the operating frequency of the antenna apparatus, that is, 2λ, and the third-order mode beam pattern is used, it can be seen that about three main lobes (main beam patterns) are generated. Also, when the distance d between the two ridge horn antennas is six times the half wavelength 0.5λ of the operating frequency, that is, 3λ, and the third-order mode beam pattern is used, it can be seen that about five main lobes (main beam patterns) are generated. Further, when the distance d between the two ridge horn antennas is 12 times the half wavelength 0.5λ of the operating frequency, that is, 6λ, and the third-order mode beam pattern is used, it can be seen that about 11 main lobes (main beam patterns) are generated.

As the distance d between the two ridge horn antennas having the same signal amplitude and phase increases, a characteristic of outer main lobes (main beam patterns) deteriorates, and thus the d between the two ridge horn antennas may be substantially 6λ or less.

Figure 9:
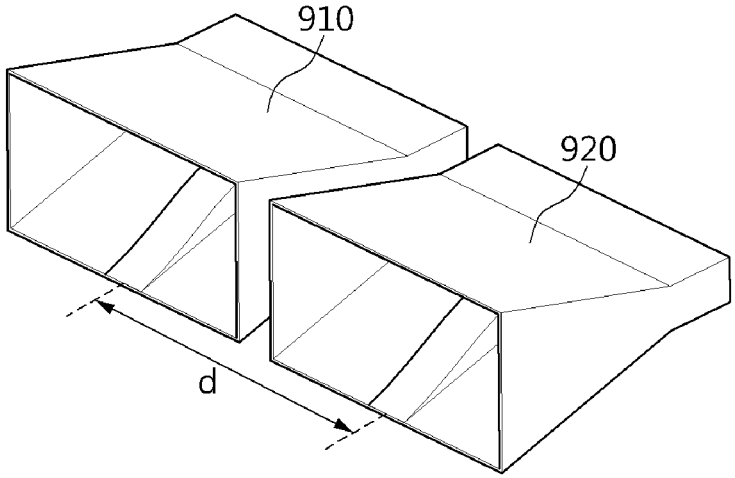
FIG. 9 is a perspective view showing a constitution of an antenna apparatus according to an example embodiment of the present invention.

FIG. 9 is a perspective view showing a constitution of an antenna apparatus according to an example embodiment of the present invention.

It is assumed that antenna devices arranged in an antenna apparatus according to an example embodiment of the present invention are excited by same signal amplitude and phase of the arranged antenna devices. Also, it is assumed that a visible range is one period or more.

Referring to FIG. 9, the antenna apparatus may include a first ridge horn antenna 910 and a second ridge horn antenna 920.

The first ridge horn antenna 910 and the second ridge horn antenna 920 may have a third-order mode beam pattern of which radiation pattern is the quasi-cardioid form as described above.

The antenna apparatus includes the first ridge horn antenna 910 and the second ridge horn antenna 920 spaced apart from the first ridge horn antenna 910 by a determined distance d. A multi-beam pattern may be formed by a third-order mode beam pattern of a synthetic beam of beams respectively radiated from the first and second ridge horn antennas 910 and 920 as mentioned above.

Here, the determined distance d may be obtained using an array factor (AF). The AF of the array antenna may be expressed as Equation 1 below.

$$AF = \sum_{n=0}^{N-1} A_n e^{jn\psi} \qquad \text{[Equation 1]}$$

$$\psi = \beta d \cos\theta - \alpha$$

In Equation 1, AF denotes the shape of an array of the antenna devices.

In Equation 1, $A_n$ denotes the amplitude of the individual devices, 13 denotes a phase constant (phase constant in a free space=2π/λ), d denotes the distance between the antenna devices, θ denotes the inclination angle of a traveling wave with respect to an array axis, α denotes a phase difference between the antenna devices, n denotes the number of antenna devices, and βd cos θ denotes a visible range. When the visible range exceeds one period, a grating lobe, that is, a spurious wave, is generated.

Here, the determined distance d is related to the phase constant β, the inclination angle θ of the traveling wave with respect to the array axis, and the phase difference α between the antenna devices.

Also, when the determined distance d is extended an odd number of times a half wavelength (0.5λ), as many main beam patterns as the odd number of times may be generated, and when the determined distance d is extended an even number of times the half wavelength (0.5λ), as many main beam patterns as a number calculated by subtracting one from the even number of times may be generated.

For example, when the distance d between the first ridge horn antenna 910 and the second ridge horn antenna 920 is 1.5λ, which is three times the half wavelength (0.5λ), three main beam patterns may be generated using the third-order mode beam pattern. Also, when the distance d between the first ridge horn antenna 910 and the second ridge horn antenna 920 is 2.0λ, which is four times the half wavelength (0.5λ), three main beam patterns may be generated using the third-order mode beam pattern.

In the above-described antenna apparatus according to an example embodiment of the present invention, two ridge horn antennas are disposed to have a determined distance, and a third-order mode beam pattern of the two ridge horn antennas may be used to generate a multi-beam pattern.

Consequently, the antenna apparatus can be simplified, and a desired multi-beam pattern can be generated without adjusting signal level and phase of each antenna device. Also, by employing the ridge horn antennas as array devices, the antenna apparatus can be used in a wide frequency band.

While the example embodiments of the present invention and their advantages have been described in detail, it should be understood that various changes, substitutions and alterations may be made herein without departing from the scope of the invention.

What is claimed is:

1. An antenna apparatus, comprising:

a first ridge horn antenna; and a second ridge horn antenna spaced apart from the first ridge horn antenna by a determined distance, wherein a multi-beam pattern is generated using a third-order mode beam pattern of a synthetic beam obtained by synthesizing beams respectively radiated from the first and second ridge horn antennas.

2. The antenna apparatus of claim 1, wherein the determined distance is obtained by changing at least one of a phase constant, an inclination angle of a traveling wave with respect to an array axis, and a phase difference between antenna devices.

3. The antenna apparatus of claim 1, wherein, when the first ridge horn antenna and the second ridge horn antenna are spaced apart by a distance corresponding to an odd number of times a half wavelength of an operating frequency, as many main beam patterns as the odd number of times are generated.

4. The antenna apparatus of claim 1, wherein, when the first ridge horn antenna and the second ridge horn antenna are spaced apart by a distance corresponding to an even number of times a half wavelength of an operating frequency, as many main beam patterns as a number calculated by subtracting one from the even number of times are generated.

5. The antenna apparatus of claim 1, wherein the determined distance is $6\lambda$ or less.

* * * * *